US007135635B2

(12) United States Patent
Childs et al.

(10) Patent No.: US 7,135,635 B2
(45) Date of Patent: Nov. 14, 2006

(54) SYSTEM AND METHOD FOR MUSICAL SONIFICATION OF DATA PARAMETERS IN A DATA STREAM

(75) Inventors: Edward P. Childs, Sharon, VT (US); Stefan Tomic, Davis, CA (US)

(73) Assignee: Accentus, LLC, Hanover, NH (US)

( * ) Notice: Subject to any disclaimer, the term of this patent is extended or adjusted under 35 U.S.C. 154(b) by 0 days.

(21) Appl. No.: 11/101,185

(22) Filed: Apr. 7, 2005

(65) Prior Publication Data

US 2005/0240396 A1 Oct. 27, 2005

Related U.S. Application Data

(63) Continuation-in-part of application No. 10/446,452, filed on May 28, 2003.

(60) Provisional application No. 60/560,500, filed on Apr. 7, 2004.

(51) Int. Cl.
*G10H 1/00* (2006.01)

(52) U.S. Cl. ..... 84/600; 84/609; 700/94

(58) Field of Classification Search ..... 84/600–608, 84/609; 700/94
See application file for complete search history.

(56) References Cited

U.S. PATENT DOCUMENTS

| | | | | |
|---|---|---|---|---|
| 4,504,933 | A | 3/1985 | Janney | 367/197 |
| 4,576,178 | A | 3/1986 | Johnson | 600/483 |
| 4,653,498 | A | 3/1987 | New, Jr. et al. | 600/324 |
| 4,785,280 | A | 11/1988 | Fubini et al. | 340/438 |
| 4,812,746 | A | 3/1989 | Dallas, Jr. | 324/121 R |
| 4,996,409 | A | 2/1991 | Paton et al. | 219/130.01 |
| 5,095,896 | A | 3/1992 | Omoigui | 128/200.26 |
| 5,285,521 | A | 2/1994 | Holt et al. | 704/270 |
| 5,293,385 | A | 3/1994 | Hary | 714/38 |
| 5,360,005 | A | 11/1994 | Wilk | 600/437 |
| 5,371,854 | A | 12/1994 | Kramer | 704/270 |
| 5,508,473 | A | 4/1996 | Chafe | 84/659 |
| 5,537,641 | A | 7/1996 | Da Vitoria Lobo et al. | 345/419 |
| 5,606,144 | A | 2/1997 | Dabby | 84/649 |
| 5,675,708 | A | 10/1997 | Fitzpatrick et al. | 704/270 |
| 5,730,140 | A | 3/1998 | Fitch | 600/514 |
| 5,798,923 | A | 8/1998 | Laskowski | 702/5 |
| 5,801,969 | A | 9/1998 | Nagahama | 703/9 |
| 5,836,302 | A | 11/1998 | Homuth et al. | 128/205.23 |
| 5,923,329 | A | 7/1999 | Beale | 345/418 |
| 6,000,833 | A | 12/1999 | Gershenfeld et al. | 84/600 |
| 6,016,483 | A * | 1/2000 | Rickard et al. | 705/36 R |

(Continued)

FOREIGN PATENT DOCUMENTS

| | | |
|---|---|---|
| WO | WO 03/107121 | 12/2003 |

OTHER PUBLICATIONS

CME—Chicago Mercantile Exchange—website print-out, Trade CME Products, E-quotes, 1 pg.

(Continued)

*Primary Examiner*—Lincoln Donovan
*Assistant Examiner*—David S. Warren
(74) *Attorney, Agent, or Firm*—Grossman Tucker Perreault & Pfleger, PLLC

(57) ABSTRACT

One embodiment of a musical sonification system and method receives a data stream including different data parameters. The sonification system may apply different sonification processes to the different data parameters to produce a musical rendering of the data stream. In one embodiment, the sonification system and method maps data parameters related to options trades to pitch values corresponding to musical notes in an equal tempered scale.

28 Claims, 5 Drawing Sheets

U.S. PATENT DOCUMENTS

| | | | | |
|---|---|---|---|---|
| 6,083,163 | A | 7/2000 | Wegner et al. | 600/429 |
| 6,088,675 | A | 7/2000 | MacKenty et al. | 704/270 |
| 6,137,045 | A | 10/2000 | Short et al. | 84/603 |
| 6,243,663 | B1 | 6/2001 | Baty et al. | 703/2 |
| 6,283,763 | B1 | 9/2001 | Matsuzaki et al. | 434/262 |
| 6,296,489 | B1 | 10/2001 | Blass et al. | 434/185 |
| 6,356,860 | B1 | 3/2002 | Barnette | 703/2 |
| 6,442,523 | B1 | 8/2002 | Siegel | 704/270 |
| 6,449,501 | B1 | 9/2002 | Reuss | 600/323 |
| 6,505,147 | B1 | 1/2003 | Kumashiro | 703/2 |
| 6,516,292 | B1 | 2/2003 | Yahalom | 703/9 |
| 6,876,981 | B1 * | 4/2005 | Berckmans | 705/35 |
| 2002/0002458 | A1 | 1/2002 | Owen et al. | 704/260 |
| 2002/0156807 | A1 | 10/2002 | Dieberger | 715/501.1 |
| 2002/0177986 | A1 | 11/2002 | Moeckel et al. | 703/9 |
| 2005/0055267 | A1 | 3/2005 | Chasanoff et al. | 704/270 |

OTHER PUBLICATIONS

"Mapping a single data stream to multiple auditory variables: A subjective approach to creating a compelling design", [online], [retrieved Mar. 10, 2005], URL:http://www.icad.org, Proceedings ICAD conference 1996.

Childs et al., "Marketbuzz: Sonification of Real-Time Financial Data", [online; viewed Mar. 10, 2005], www.icad.org, Proceedings of ICAD conference 2004.

Lodha et al., "MUSE: A Musical Data Sonification Toolkit", www.icad.org, 1997.

Flowers et al., "Sonification of Daily Weather Records: Issues of Perception, Attention, And Memory in Design Choices", www.icad.org, Proceedings of ICAD conference 2001.

Van Scoy, "Sonification of Complex Data Sets: An Example from Basketball", [online, viewed Mar. 10, 2005] www.csee.wvu.edu/~vanscoy/vsmm99/webmany/FLVS11.htm.

"Music from the Ocean" [online, retrieved Mar. 10, 2005] www.composerscientist.com/csr.html.

"Rock around the Bow Shock" [online, retrieved Mar. 10, 2005], www-ssg.sr.unh.edu/tof/Outreach/music/cluster/.

Childs et al., "Using Multi-Channel Spatialization in Sonification: A Case Study with Meteorological Data", www.icad.org, Proceedings of ICAD conference 2003.

PCT International Search Report and Written Opinion dated Feb. 15, 2006, received in corresponding PCT application No. PCT/US05/11743 (6 pages).

* cited by examiner

SYSTEM AND METHOD FOR MUSICAL SONIFICATION OF DATA PARAMETERS IN A DATA STREAM

CROSS-REFERENCE TO RELATED APPLICATIONS

This application claims the benefit of U.S. Provisional Application Ser. No. 60/560,500 filed Apr. 7, 2004, which is fully incorporated by reference. This application is also a continuation-in-part of U.S. patent application Ser. No. 10/446,452, filed on May 28, 2003, which is fully incorporated herein by reference.

TECHNICAL FIELD

The present invention relates to musical sonification and more particularly, to musical sonification of a data stream including different data parameters, such as a financial market data stream resulting from trading events.

BACKGROUND INFORMATION

For centuries, printed visual displays have been used for displaying information in the form of bar charts, pie charts and graphs. In the information age, visual displays (e.g., computer monitors) have become the primary means for conveying large amounts of information. Computers with visual displays, for example, are often used to process and/or monitor complex numerical data such as financial trading market data, fluid flow data, medical data, air traffic control data, security data, network data and process control data. Computational processing of such data produces results that are difficult for a human overseer to monitor visually in real time. Visual displays tend to be overused in real-time data-intensive situations, causing a visual data overload. In a financial trading situation, for example, a trader often must constantly view multiple screens displaying multiple different graphical representations of real-time market data for different markets, securities, indices, etc. Thus, there is a need to reduce visual data overload by increasing perception bandwidth when monitoring large amounts of data.

Sound has also been used as a means for conveying information. Examples of the use of sound to convey information include the Geiger counter, sonar, the auditory thermometer, medical and cockpit auditory displays, and Morse code. The use of non-speech sound to convey information is often referred to as auditory display. One type of auditory display in computing applications is the use of auditory icons to represent certain events (e.g., opening folders, errors, etc.). Another type of auditory display is audification in which data is converted directly to sound without mapping or translation of any kind. For example, a data signal can be converted directly to an analog sound signal using an oscillator. The use of these types of auditory displays have been limited by the sound generation capabilities of computing systems and are not suited to more complex data.

Sonification is a relatively new type of auditory display. Sonification has been defined as a mapping of numerically represented relations in some domain under study to relations in an acoustic domain for the purposes of interpreting, understanding, or communicating relations in the domain under study (C. Scaletti, "Sound synthesis algorithms for auditory data representations," in G. Kramer, ed., International Conference on Auditory Display, no. XVIII in Studies in the Sciences of Complexity, (Jacob Way, Reading, Mass. 01867), Santa Fe Institute, Addison-Wesley Publishing Company, 1994.). Using a computer to map data to sound allows complex numerical data to be sonified.

The human ability to recognize patterns in sound presents a unique potential for the use of auditory displays. Patterns in sound may be recognized over time, and a departure from a learned pattern may result in an expectation violation. For example, individuals establish a baseline for the "normal" sound of a car engine and can detect a problem when the baseline is altered or interrupted. Also, the human brain can process voice, music and natural sounds concurrently and independently. Music, in particular, has advantages over other types of sound with respect to auditory cognition and pattern recognition. Musical patterns may be implicitly learned, recognizable even by non-musicians, and aesthetically pleasing. The existing auditory displays have not exploited the true potential of sound, and particularly music, as a way to increase perception bandwidth when monitoring data. Thus, existing sonification techniques do not take advantage of the auditory cognition attributes unique to music.

One area in which large amounts of data must be monitored is options trading. Automated programs may be used to execute equity options trades. Computer programs may also be used to monitor portfolio changes in data parameters such as delta, gamma and vega for these trades. Currently, a single beep alert is generated for each trade that occurs. This traditional alarm strategy fails to capitalize on the opportunity to provide valuable additional information about the trade and its resulting effect on the overall options portfolio using human auditory cognition.

Accordingly, there is a need for a musical sonification system and method capable of providing a musical rendering of a data stream including multiple data parameters such that changes in musical notes indicate changes in the different data parameters. There is also a need for a musical sonification system and method capable of providing a musical rendering of a financial data stream, such as an options portfolio data stream, such that changes in musical notes indicate changes in options data parameters at a portfolio level.

BRIEF DESCRIPTION OF THE DRAWINGS

These and other features and advantages of the present invention will be better understood by reading the following detailed description, taken together with the drawings wherein.

DETAILED DESCRIPTION

Figure 1:
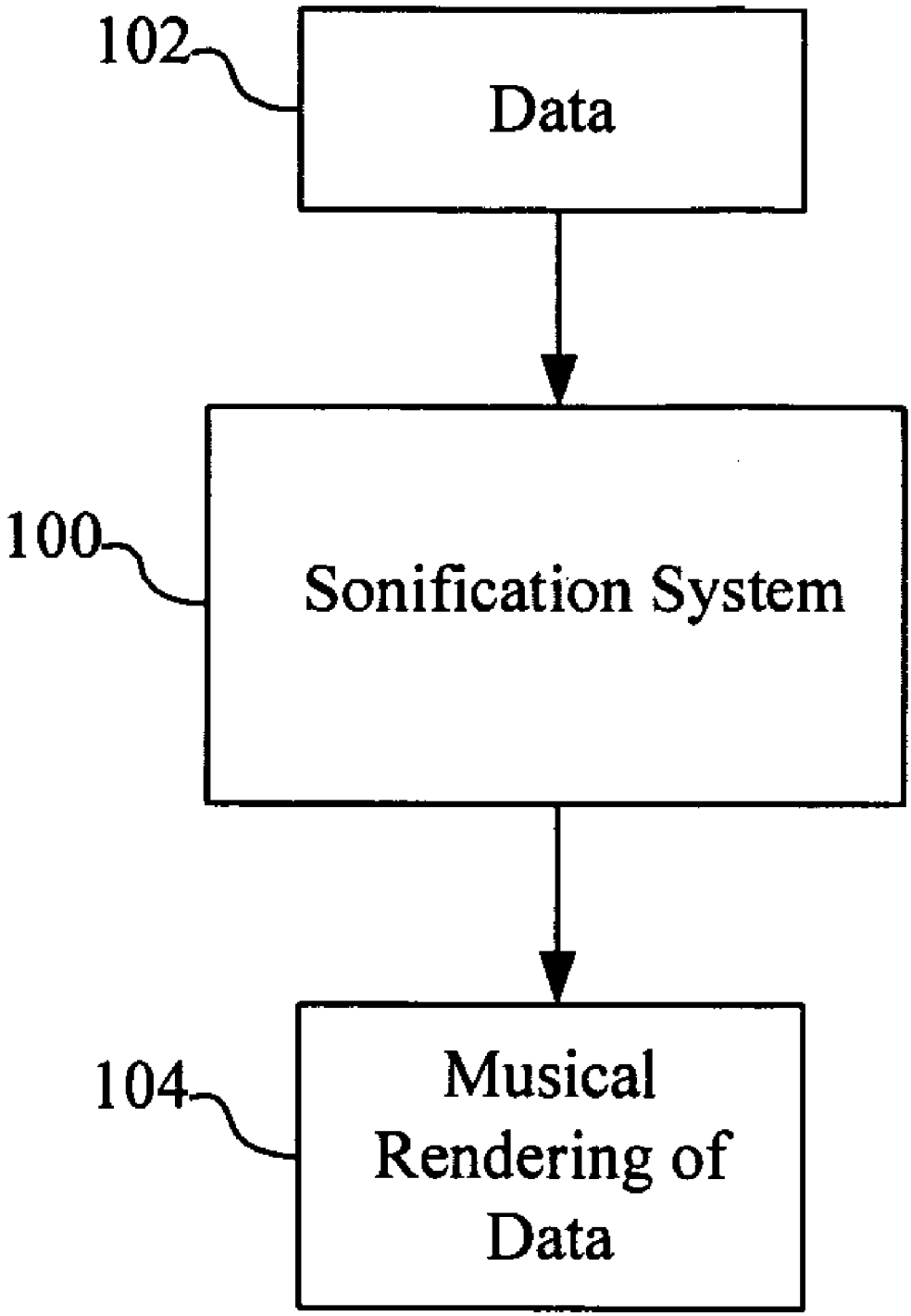
FIG. 1 is a schematic block diagram of a sonification system consistent with one embodiment of the present invention.

Referring to FIG. 1, a sonification system 100 may receive a data stream 102 and may generate a musical rendering 104 of data parameters in the data stream 102. Embodiments of the present invention are directed to musical sonification of complex data streams within various types of data domains, as will be described in greater detail below. Musical sonification provides a data transformation such that the relations in the data are manifested in corresponding musical relations. The musical sonification preferably generates "pleasing" musical sounds that yield a high degree of human perception of the underlying data stream, thereby increasing data perception bandwidth. As used herein, "music" or "musical" refers to the science or art of ordering tones or sounds in succession, in combination, and in temporal relationships to produce a composition having unity and continuity. Although the music used in the present invention is preferably common-practice music and the exemplary embodiments of the present invention use western musical concepts to produce pleasing musical sounds, the terms "music" and "musical" are not to be limited to any particular style or type of music.

The sonification system 100 may apply different sonification schemes or processes to different data parameters in the data stream 102. Each of the different sonification processes may produce one or more musical notes that may be combined to form the musical rendering 104 of the data stream 102. The raw data in the data stream 102 may correspond directly to musical notes or the raw data may be manipulated or translated to obtain other data values that correspond to the musical notes. The user may listen to the musical rendering 104 of the data stream 102 to discern changes in each of the different data parameters over a period of time and/or relative to other data parameters. The distinction between the data parameters may be achieved by different pitch ranges, instruments, duration, and/or other musical characteristics.

Figure 2:
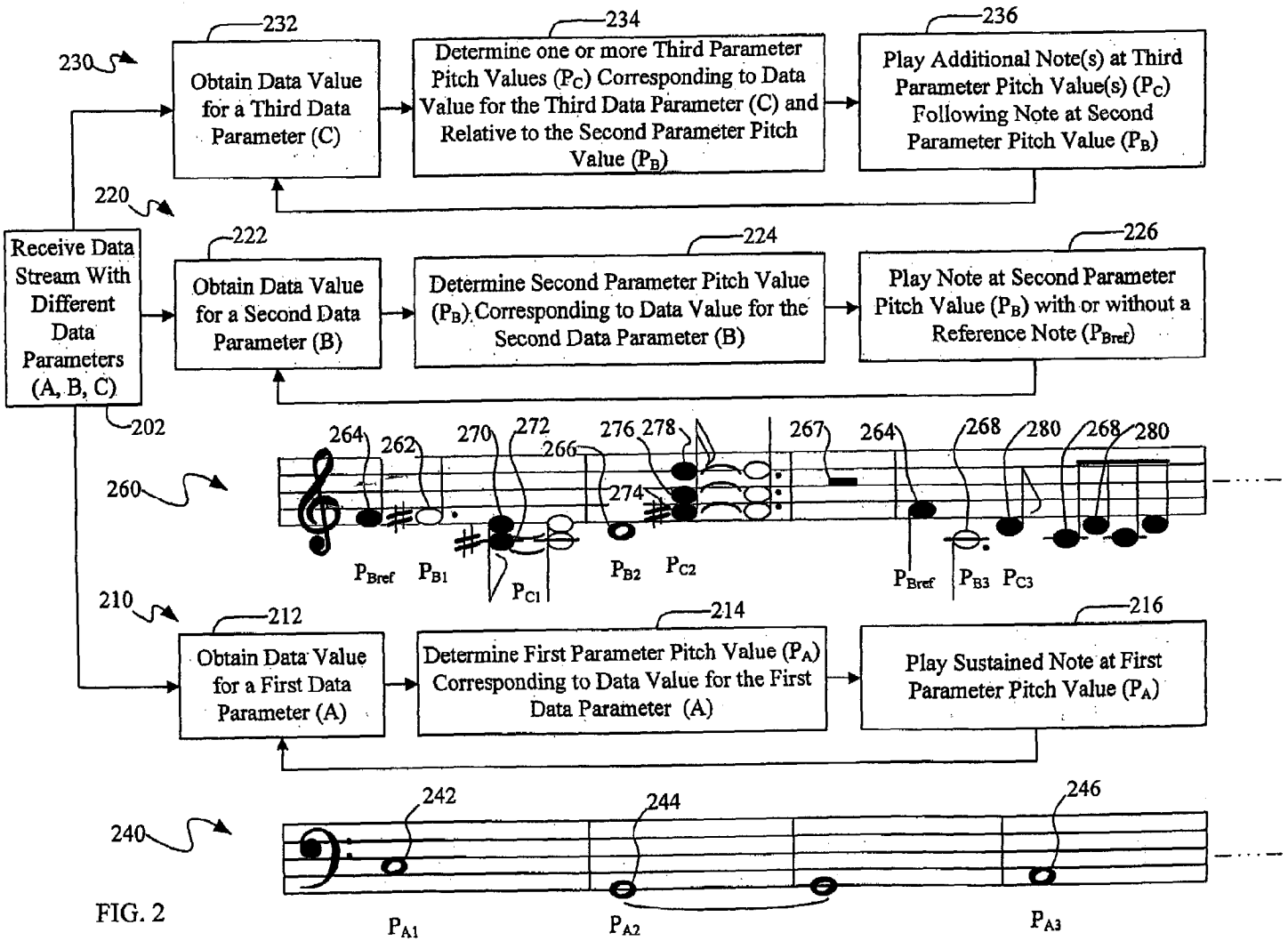
FIG. 2 is a flow chart illustrating a method of musical sonification of different parameters in a data stream, consistent with one embodiment of the present invention.

One embodiment of a sonification method including different sonification processes 210, 220, 230 applied to different data parameters is shown in greater detail in FIG. 2. According to this method, the sonification system 100 receives a data stream having the different data parameters (e.g., A, B, C), operation 202. The data stream may include a stream of numerical values for each of the different data parameters. In one embodiment, the data stream may be provided as a series of data elements with each data element corresponding to a data event. Each of the data elements may include numerical values for each of the data parameters (e.g., A1, B1, C1, . . . A2, B2, C2, . . . A3, B3, C3, . . . ).

According to each of the sonification processes 210, 220, 230 applied to the different data parameters (e.g., A, B, C) in the data stream, the sonification system 100 may obtain data values for each of the different data parameters in the data stream, operations 212, 222, 232. The data values obtained for the different data parameters may be raw data or numerical values obtained directly from the data stream or may be obtained by manipulating the raw data in the data stream. To communicate information describing a series of events collectively, for example, the data value may be obtained by calculating a moving sum of the raw data in the data stream or by calculating a weighted average of the raw data in the data stream, as described in greater detail below. Such data values may be used to provide a more global picture of the data stream. The manipulations or calculations to be applied to raw data to obtain the data values may depend on the type of data stream and the application.

The sonification system may then apply the different sonification processes 210, 220, 230 to the data values obtained for each of the data parameters (e.g., A, B, C) to produce one or more musical parts 240, 260 that form the musical rendering 104 of the data stream. The parts 240, 260 of the musical rendering may be arranged and played using different pitch ranges, musical instruments and/or other music characteristics. The sonifications of different data parameters may be independent of each other to produce different parts 240, 260 corresponding to different parameters (e.g., sonifications of parameters A and B respectively). The sonifications of different data parameters may also be related to each other to produce one part 260 representing multiple parameters (e.g., sonification of both data parameters B and C).

According to one sonification process 210, the sonification system 100 may determine one or more first parameter pitch values ($P_A$) corresponding to the data value obtained for the first data parameter (A), operation 214. The pitch values ($P_A$) may correspond to musical notes on an equal tempered scale (e.g., on a chromatic scale). A half step on the chromatic scale, for example, may correspond to a significant movement of the data parameter. The sonification system 100 may then play one or more sustained notes at the determined pitch value(s) ($P_A$) corresponding to the data value, operation 216. The sonification process 210 may be repeated for each successive data value obtained for the first data parameter (A) of the data stream, resulting in multiple sonification events. Successive sonification events may occur, for example, when a significant movement results in a pitch change to another note or at defined time periods. Each sustained note may be played until the next sonification event.

According to one example sonification, the sonification process 210 applied to a series of data values (A1, A2, A3, . . . ) obtained for the first data parameter (A) produces a series of sonifications forming the part 240. A first data value (A1) may produce a sustained note 242 at pitch $P_{A1}$. A second data value (A2) may produce a sustained note 244 at pitch $P_{A2}$, which is five (5) half steps below the note 242, indicating a decrease of about five significant movements. A period of time in which there are no sonification events may result in the sustained note 244 being played through another bar or measure. A third data value (A3) may produce a sustained note 246 at pitch $P_{A3}$, which is one (1) half step above the note 244, indicating an increase of about one (1) significant movement. Thus, changes in the pitch of the sustained notes that are played at the first parameter pitch value(s) ($P_A$), as a result of the sonification process 210, indicate changes in the first data parameter (A) in the data stream. Although the exemplary embodiment shows single sustained notes 242, 244, 246 being played for each of the data values (A1, A2, A3), those skilled in the art will recognize that multiple notes may be played together (e.g., as a chord) for each of the data values.

According to another sonification process 220, the sonification system 100 may determine one or more second parameter pitch values ($P_B$) corresponding to the data value obtained for the second data parameter (B), operation 224. The pitch values ($P_B$) for the second data parameter may also correspond to musical notes (e.g., on the chromatic scale) and may be within a pitch range that is different from a pitch range for the first data parameter to allow the sonifications of the first and second data parameters to be distinguished. The sonification system 100 may then play one or more notes at the determined pitch value(s) ($P_B$), operation 244. The note(s) played for the second data parameter (B) may be played for a limited duration and may be played with a reference note ($P_{Bref}$) to provide a reference point for a change in pitch indicating a change in the second data parameter (B). The reference note may correspond to a predetermined data value obtained for the second data parameter (e.g., 0) or may correspond to a first note played for the second data parameter. The sonification process 220 may be repeated for each successive data value obtained for the second data parameter (B) of the data stream, resulting in multiple sonification events. Successive sonification events may occur when each data value is obtained for the second data parameter or may occur less frequently, for example, when a significant movement results in a pitch change to another note or at defined time periods. Thus, there may be a period of time between sonification events where notes are not played for the second data parameter.

According to one example sonification, the sonification process 220, applied to a series of data values (B1, B2, B3, . . . ) obtained for the second data parameter (B) produces a series of sonification events in the part 260. A first data value (B1) may produce note 262 at pitch $P_{B1}$. The note 262 may be played following, and one half step above, a reference note 264 at pitch $P_{Bref}$, indicating that the first data value (B1) has increased one significant movement from a reference value (e.g., $B_{ref}=0$). A second data value (B2) may produce a note 266 at pitch $P_{B2}$, which is three half steps below the reference note 264, indicating that the second data value (B2) has decreased by three significant movements from the reference value (Bref). The note 266 may be played without a reference note because it is played relatively close to the previous sonification event. A period of time where there is no sonification event for the second data parameter is indicated by a rest 267 where no notes are played. A third data value (B3) may produce note 268 at pitch $P_{B3}$, which may be played following the reference note 268. The note 268 is played five half steps below the reference note 264, indicating that the third data value has decreased by three significant movements from the reference value. Thus, changes in the pitch of the notes played at the second parameter pitch value(s) ($P_B$), as a result of the sonification process 220, indicate changes in the second data parameter (B) in the data stream.

According to a further sonification process 230 related to the second sonification process 220, the sonification system 100 may determine one or more third parameter pitch values ($P_C$) corresponding to the third data parameter (C), operation 234. The pitch values for the third data parameter correspond to musical notes (e.g., on the chromatic scale) and may be determined relative to the notes played for the second parameter pitch value ($P_B$) (e.g., at predefined interval spacings). The sonification system 100 may then play additional note(s) at the third parameter pitch value(s) $P_C$ following the note(s) played at the second parameter pitch value(s) ($P_B$), operation 236. Thus, the sonifications of the second and third data parameters are related. According to one variation of this sonification process 230, the additional notes may be played simultaneously (e.g., a triad or chord) to produce a harmony, where the number of additional notes in the harmony corresponds to the magnitude of the data value obtained for the third data parameter. According to another variation of this sonification process 230, the additional notes may be played sequentially (e.g., a tremolo or trill) to produce an effect such as reverberation, echo or multi-tap delay, where the tempo of the notes played in sequence corresponds to the magnitude of the data value obtained for the third data parameter.

According to one example sonification, the related sonification process 230 applied to a series of data values (C1, C2, C3, . . . ) obtained for the third data parameter (C) produces additional sonification events in the part 260. With respect to the third data parameter, a first data value (C1) may produce two notes 270, 272 played together. The notes 270, 272 may be played following and together with the note 262 for the first data value (B1) for the second data parameter and at a pitch below the note 262. The notes 262, 270, 272 may form a minor triad (with the note 262 as the tonic or root note of the chord) indicating that the first data value (C1) is within an undesirable range. The second data value (C2) may produce three notes 274, 276, 278 played together. The notes 274, 276, 278 may be played following and together with the note 266 for the second data value (B2) for the second data parameter and at a pitch above the note 266. The notes 266, 274, 276, 278 may form a major chord (with the note 266 as the tonic or root note of the chord) indicating that the second data value is in a desirable range. The additional note played in the harmony or chord for the data value (C2) indicates that the magnitude of the third data parameter has increased.

Alternatively, the additional notes for the related sonification process 230 may be played in sequence. For example, a third data value (C3) may produce an additional note 280 one whole step above the note 268 played for the third data value (B3) for the second data parameter, and the two notes 268, 280 may be played in rapid alternation, for example, as a trill or tremolo. The number of notes or the tempo at which the notes 268, 280 are played in rapid alternation may indicate the magnitude of the third data value (C3) for the third data parameter.

The musical parts 240, 260 together form a musical rendering of the data stream. A sonification of a few data values for each data parameter is shown for purposes of simplification. The sonification processes 210, 220, 230 can be applied to any number of data values to produce any number of notes and sonification events. Although the exemplary method involves three different sonification processes 210, 220, 230 applied to different data parameters, any combination of the sonification processes 210, 220, 230 may be used together or with other sonification processes. Although the exemplary embodiment shows a specific time signature and values for the notes, those skilled in the art will recognize that various time signatures and note values may be used. Although the exemplary embodiment shows sonification events corresponding to measures of music, the sonification events may occur more or less frequently. The illustrated exemplary embodiment shows the parts 240, 260 on the bass clef and treble clef, respectively, because of the different pitch ranges. Those skilled in the art will also recognize that various pitch values and pitch ranges may be used for the notes. One embodiment uses MIDI (Musical Instrument Digital Interface) pitch values, although other values used to represent pitch may be used. Those skilled in the art will also recognize that other musical effects may be incorporated.

Figure 3:
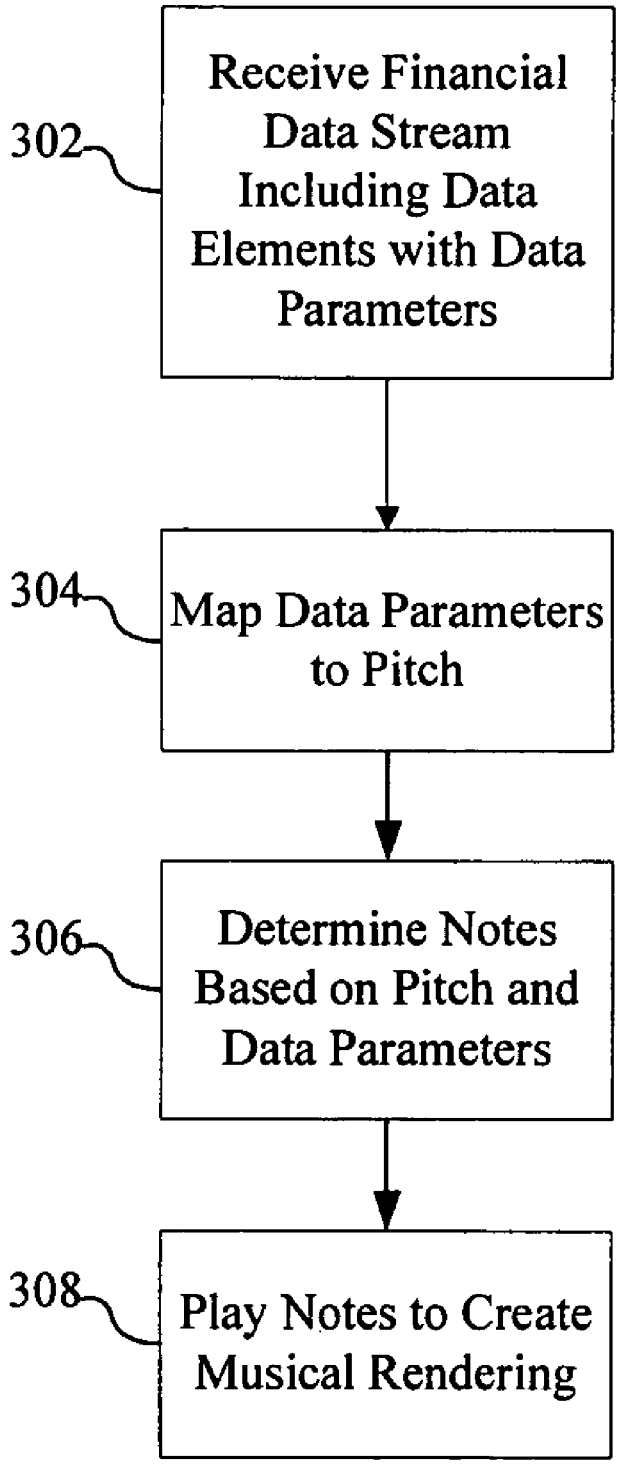
FIG. 3 is a flow chart illustrating a method of musical sonification of a financial data stream, consistent with one embodiment of the present invention.

Referring to FIG. 3, one embodiment of the sonification system 100 may be used to sonify financial data streams, such as options trading data originating from trading software. According to this method, the sonification system 100 may receive a financial data stream including a series of data elements corresponding to a series of trading events, operation 302. Each of the data elements may include a unique date and time stamp corresponding to specific trading events. Each of the data elements may also include values for the data parameters, which may reflect a change in the data parameter as a result of the particular trading event. The financial data stream may include data elements for trades relating to a particular security or to an entire portfolio.

The sonification system 100 may map the data parameters in the financial data stream to pitch, operation 304. The sonification system 100 may then determine the notes to be played based on the pitch and based on the data parameters, operation 306. For example, the sonification system 100 may use the sonification method described above (see FIG. 2) to map the different data parameters to pitch depending on the data values obtained for the data parameters and to determine the note(s) to be played based on the type of data parameter (e.g., sustained notes, harmonies, repetitive notes). The sonification system 100 may then play the notes to create the musical rendering of the financial data stream, operation 308. The sonification system 100 may be configured such that each of the data elements corresponding to a trading event results in a sonification event or such that sonification events occur less frequently. The sonification of the financial data stream may be used to provide a global picture of the financial data, for example, a portfolio level view of how portfolio values change as a result of each trade.

One embodiment of this sonification system and method may be used for options trading, as described in greater detail below. In options trading, data parameters relating to an options trade may include delta (δ), gamma (γ), vega (υ), expiration (E) and strike (S). In the exemplary embodiment, each data element in the data stream may contain the changes in delta (δ), gamma (γ) and vega (υ) resulting from a single trade, in dollars ($), together with the expiration (E) in days and the strike (S) in standard deviations, related to that trade.

The delta, gamma and vega data parameters may be mapped to pitch by such that changes in the portfolio values of the delta, gamma and vega over a period of time result in changes in pitch. To provide a portfolio level sonification, for example, data values may be obtained for the data parameters delta, gamma and vega by calculating a weighted moving sum. The moving sum of delta, gamma, and vega, respectively, can be calculated according to:

$$\Delta = \sum_{i=1}^{N} A_i \delta_i \tag{1}$$

$$\Gamma = \sum_{i=1}^{N} A_i \gamma_i \tag{2}$$

$$Y = \sum_{i=1}^{N} A_i \upsilon_i \tag{3}$$

where the summation would start from 1 at the beginning of each trading day and $$A_i = f(t_i, t_{window}) \tag{4}$$

is a weighting factor which is some function of the current time (t), time stamp i ($t_i$), and the length of time ($t_{window}$) over which the moving sum is to be calculated. A simple example of such a function is:

$$A_i = 1, \text{ if } |t - t_i| \leq t_{window} \tag{5}$$

$$A_i = 0, \text{ if } |t - t_i| > t_{window} \tag{6}$$

where (t) is the current time and ($t_i$) is the ith time stamp, for i=1 up to the current time. Piecewise linear functions for the weighting factor $A_i$ may be used for more complicated functions. The weighting factor $A_i$ may be defined and/or modified by the user of the system.

These weighted moving sums (Δ, Γ and Y) may then be mapped to MIDI pitch P as follows:

$$P_\Delta = \left[\frac{P_{\min_\Delta} + P_{\max_\Delta}}{2}\right] + \Delta \frac{(P_{\max_\Delta} - P_{\min_\Delta})}{(\Delta_{\max} - \Delta_{\min})^k}, \quad \text{for } \Delta_{\min}(= -\$5MM) \leq \Delta \leq \Delta_{\max}(= \$5MM) \tag{7}$$

where the above equation is for Δ, the weighted moving sum for delta. The equations for Γ and Y are analogous:

$$P_\Gamma = \left[\frac{P_{\min_\Gamma} + P_{\max_\Gamma}}{2}\right] + \Gamma \frac{(P_{\max_\Gamma} - P_{\min_\Gamma})}{(\Gamma_{\max} - \Gamma_{\min})^k}, \quad \text{for } \Gamma_{\min}(= -\$1MM) \leq \Gamma \leq \Gamma_{\max}(= \$1MM) \tag{8}$$

$$P_Y = \left[\frac{P_{\min_Y} + P_{\max_Y}}{2}\right] + Y \frac{(P_{\max_Y} - P_{\min_Y})}{(Y_{\max} - Y_{\min})^k}, \quad \text{for } Y_{\min}(= -\$100K) \leq Y \leq Y_{\max}(= \$100K) \tag{9}$$

The value of P calculated by the above equations can be rounded to the nearest whole number so that a pitch in the equal tempered scale results. In the MIDI system, for example, P=60 corresponds to middle C. The pitch range P for each data parameter delta, gamma and vega may be different. For example, the pitch range for the weighted moving sum of delta (Δ) may be in a low register (e.g., with a continual string ensemble sound), the pitch range for the weighted moving sum of gamma (Γ) may be in the midrange, and the pitch range for the weighted moving sum of vega (Y) may be higher. The exponent k in the above three equations (7–9) may be set by the user and controls the distribution of pitch with respect to the moving sum; for example, k=1 yields a linear distribution.

The note(s) to be played at the determined pitch value may depend on the data parameter being sonified. In the exemplary embodiment, a sustained note is played at the pitch $P_\Delta$ determined for the moving sum of delta and notes of limited duration are played at the pitches $P_\Gamma$ and $P_Y$ determined for the moving sums of gamma and vega. In general, the basic note based on the determined pitch P may sound whenever the current calculated value of pitch P varies from the previous value at which it sounded by a whole number (e.g., at least a half step change on the chromatic scale). If there is a substantial time lapse between sonification events, a reference note representing a gamma and vega of 0 may sound before the calculated pitch values $P_\sigma$ and $P_Y$ are sounded. If several sonification events occur in rapid succession, the reference note may not sound because the trend based on the current notes and immediately previous notes should be apparent.

In the exemplary embodiment, the data parameter delta stands alone as a one-dimensional variable, whereas the data parameters gamma and vega are 'loaded' with the additional data parameters expiration E and strike S. Thus, the sonifications of the expiration E and strike S data parameters may be related to the sonification of the gamma and vega parameters. In particular, the expiry and strike data parameters may be mapped to pitch values relative to the pitch values determined for the gamma and vega parameters.

The data value obtained for the expiry E and the strike S data parameters may be a weighted average of the expiries and strikes of all individual trades occurring between the current sonification event and the immediately previous sonification event. Alternatively, if each trade is sonified individually, the data values obtained for the expiry and strike data parameters may be the raw data values in each of the data elements.

The weighted average can be of the form:

$$E_{avg,\Gamma} = \left( \sum_{i=1}^{n} \frac{\gamma_i}{\sum_{i=1}^{N} \gamma_i} E_i^{k_{E,\gamma}} \right)^{\frac{1}{k_{E,\gamma}}} \tag{10}$$

where n is the number of trades between sonification events, and k is an exponent, to be specified by the user. The expressions for calculating the average value of E for vega and S for gamma and vega are analogous:

$$E_{avg,\nu} = \left( \sum_{i=1}^{n} \frac{\upsilon_i}{\sum_{i=1}^{n} \upsilon_i} E_i^{k_{E,\upsilon}} \right)^{\frac{1}{k_{E,\upsilon}}} \tag{11}$$

$$S_{avg,\Gamma} = \left( \sum_{i=1}^{n} \frac{\gamma_i}{\sum_{i=1}^{n} \gamma_i} S_i^{k_{S,\gamma}} \right)^{\frac{1}{k_{S,\gamma}}} \tag{12}$$

$$S_{avg,\nu} = \left( \sum_{i=1}^{n} \frac{\upsilon_i}{\sum_{i=1}^{n} \upsilon_i} S_i^{k_{E,\upsilon}} \right)^{\frac{1}{k_{E,\upsilon}}} \tag{13}$$

To represent expiration, additional notes may be added to the basic mapping of pitch P to the data values obtained for the gamma and vega parameters and played in sequence. Expiration implies distance in the future and may be sonified using an effect such as reverberation, echo, or multi-tap delay. For example, immediately pending expirations may have no reverb, while those furthest into the future may have maximum reverb. The tempo of the notes played in sequence may correspond to the magnitude of the expiration value. The type of reverb and the function relating the amount of reverb to expiration can be determined by listening experiments with actual data.

To represent strike, additional notes can be added to the basic mapping of pitch P to the data values obtained for the gamma and vega parameters and played together. In the event of an "in the money" strike, the additional notes may be higher in pitch than the basic note P to form intervals suggestive of a major triad. Major triads are traditionally believed to connote a "happy" mood. In the event of an "out of the money" strike, the additional notes may be lower in pitch than the basic note P to form intervals suggestive of a minor triad, connoting a "sad" mood. The number of notes played together may correspond to the degree of "in the money" or "out of the money." An "at the money" strike (e.g., values of strike between −0.5 and 0.5) may have no additional pitches added to the basic note.

Thus, the notes that are played indicate changes in the portfolio values of delta, gamma, and vega over a period of time. According to the exemplary sonification system and method, the notes indicating changes in delta, gamma, and vega may sound at the same time, if conditions allow. The distinction between delta, gamma, and vega may be achieved by pitch register, instrument, duration, and/or other musical characteristics. For example, the delta data parameter may be voiced as a stringed instrument with sustained tones, and thus may be the 'soloist'. The gamma data parameter may be in a middle register and the vega data parameter may be in a higher register, voiced as keyboard or mallet instruments for easy distinction and also for the expiration and strike effects to be more easily heard, as described below.

Figure 4:
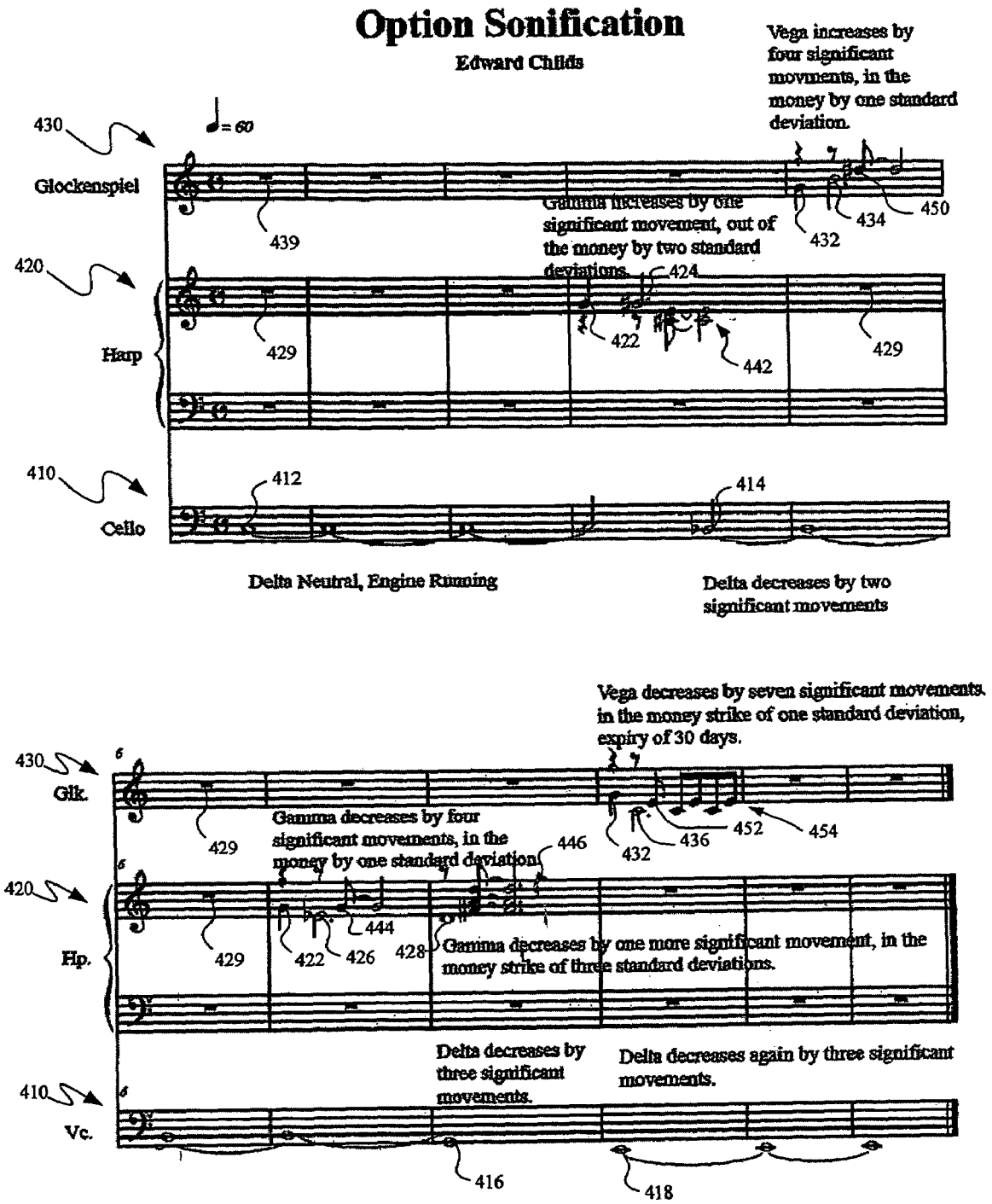
FIG. 4 is an illustration of musical notation for a portion of one example of a sonification of option trade data, consistent with one embodiment of the present invention.

An example of a musical rendering of a sample of options trading data is shown in FIG. 4. The notes for the delta, gamma and vega parameters may be played as three different parts 410, 420, 430, for example, using three different instruments. In the first part 410 for the delta parameter, the notes may be played with a Cello as the instrument and in a lower pitch range, as indicated by the bass clef. Initially, the sustained C note 412 (MIDI P=48) plays while the delta is neutral. When the delta decreases by two significant movements, the note 412 stops playing and the sustained B flat note 414 (MIDI P=46) begins playing. When the delta decreases by three significant movements, the note 414 stops playing and the sustained G note 416 (MIDI P=43) begins playing. When the delta decreases again by three significant movements, the note 416 stops playing and the sustained E note 418 (MIDI P=40) begins playing.

In the second part 420 for the gamma parameter, the notes may be played with a Harp as the instrument and in a higher pitch range, as indicated by the treble clef. When the gamma increases by one significant movement, a reference G note 422 (MIDI P=67) is played followed by a G sharp note 424 (MIDI P=68). When the gamma decreases by four significant movements, the reference note 422 is played followed by an E flat note 426 (MIDI P=63). When the gamma immediately decreases again by one more significant movement, a D note 428 (MIDI P=62) may be played without a reference note. Where there are no sonification events for the gamma parameter (e.g., where the moving sum has not changed), notes may not be played as indicated by the rests 429.

In the third part 430 for the vega parameter, the notes may be played with a Glockenspiel as the instrument and in the higher pitch range, as indicated by the treble clef. When the vega increases by four significant movements, the reference G note 432 (MIDI P=67) is played followed by a B note 434 (MIDI P=71). When the vega decreases by seven significant movements, the reference note 432 is played followed by the C note 436 (MIDI P=60). Where there are no sonification events for the vega parameter (e.g., where the moving sum has not changed), notes may not be played as indicated by the rests 439.

As shown in FIG. 4, the notes played for the expiration and strike may be played together with the notes played for the gamma and delta in the second and third parts 420, 430. When the gamma increases and the strike is out of the money by two standard deviations, a two note (C sharp and E) harmony 442 (MIDI P=64 and 61) may be played following and together with the G sharp note 424 representing the gamma increase, forming a G sharp minor triad. When the gamma decreases and the strike is in the money by one standard deviation, a single G note 444 (MIDI P=67) may be played following and together with the E flat note 426 for the gamma decrease, forming a two note harmony. When the gamma decreases and the strike is in the money by three standard deviations, a three note harmony 446 (MIDI P=66, 69, and 74) may be played following and together with the D note 428 representing the gamma decrease, forming a D major chord. When the vega increases and the strike is in the money by one standard deviation, a single D sharp note 450 (MIDI P=75) may be played following and together with the B note 434 representing the vega increase, forming a two note harmony. When the vega decreases, the strike is in the money by one standard deviation and the expiry is 30 days, a single E note 452 (MIDI P=64) is played following the C note 436 representing the vega decrease and a rapid repetition of the note 436 and the note 452 is played with quarter notes to form a trill 454.

The sonification system and method applied to options trading data may advantageously provide a palette of sounds that enable traders to receive more detailed information about how a given trade has altered portfolio values of data parameters such as delta, gamma, and vega. The musical sonification system and method is capable of generating rich, meaningful sounds intended to communicate information describing a series of trades and why they may have been executed, thereby providing a more global picture of prevailing conditions. This can lead to new insight and improved overall data perception.

The exemplary sonification systems and methods may be used to sonify a real-time data stream, for example, from an existing data source. The sonification system 100 may use a data interface, such as a relatively simple read-only interface, to receive real-time data streams. The data interface may be implemented with a basic inter-process communications mechanism, such as BSD-style sockets, as is generally known to those skilled in the art. The entity providing the data stream may provide any network and/or infrastructure specifications and implementations to facilitate communications, such as details for the socket connection (e.g., IP address and Port Number). The sonification processes may communicate with the real-time data stream processes over the sockets. The sonification system 100 may receive the real-time data with a socket listener, decode each string of data, and apply the appropriate transforms to the data in order to generate the sonification or auditory display.

When receiving option trade data, for example, an inter-process communication mechanism (e.g., a BSD-style socket) may be used to communicate a delimited ASCII data stream of the general format:

| Trade Time | Delta ($) | Gamma ($) | Vega ($) | Expiry (days) | Strike (st dev) |
|---|---|---|---|---|---|
| 9:33:56 | 46,877 | (3,750) | (67) | 33 | 0.586 |

The above message format for an exemplary data element is for illustrative purposes. Those skilled in the art will recognize that other data formats may be used.

The exemplary sonification systems and methods may also be used to sonify historical data files. When historical data files are sonified, the user may be able to adjust the speed of the playback. The exemplary sonification methods may run on historical data files to facilitate historical data analysis. For example, the sonification methods may process historical data files and generate the auditory display resulting from the data, for example, in the form of an mp3 file. The exemplary sonification methods may also run historical data files for prototyping (e.g., through rapid scenario-based testing) to facilitate user input into the design of the sonification system and method. For example, traders may convey data files representing scenarios for which auditory display simulations may be helpful to assist with their understanding of the behavior of the auditory display.

The exemplary sonification systems and methods may also be configured by the user, for example, using a graphical user interface (GUI). The user may change the runtime behavior of the auditory display, for example, to reflect changing market conditions and/or to facilitate data analysis. The user may also modify or alter equation parameters discussed above, for example, by capturing the numbers using a textbox. In particular, the user may modify the weighting factor $A_i$ (together with its functional form) and the length of time $t_{window}$ used in equations 1–6. The user may also modify the exponent k, the maximum and minimum pitch values, and the maximum and minimum values for delta, gamma, and vega used in equations 7–9. The user may also modify the exponent k used in equations 10–13.

The user may also configure the exemplary sonification methods for different data sources, for example, to receive data files in addition to connecting to a real-time data source. For example, the user may specify historical data files meeting a specific file format to be used as an alternative data source to real-time data streams.

The user may also configure the time/event space for the sonifications. Users may be able to set the threshold levels of changes in data parameters (e.g., portfolio delta, gamma and vega) that trigger a new sonification event of the data parameters. At lower thresholds, the sonification events may occur more frequently. In an exemplary embodiment, very low thresholds may result in a sonification event for each individual trade. If very low thresholds have been set and there are large changes in portfolio delta, gamma and vega, for example, the sonification events may be difficult to follow because of the large pitch changes that may result. In the case that multiple sonification events are triggered in a short period of time (e.g., for gamma or vega), the events may be queued and played back according to the user specification. In particular, users may be able to set the maximum number of sonification events per time period (e.g. 1 sonification event per second) and/or a minimum amount of time between sonification events (e.g. at least 2 seconds between sonification events).

The sonification system 100 may be implemented using a combination of hardware and/or software. One embodiment of the sonification system 100 may include a sonification engine to receive the data and convert the data to sound parameters and a sound generator to produce the sound from the sound parameters. According to one implementation, the sonification engine may execute as an independent process on a stand alone machine or computer system such as a PC including a 700 MHz PIII with 512 MB memory, Win 2K SP2, JRE 1.4. The sound generator may include a sound card and speakers. Examples of speakers that can be used include a three speaker system (i.e., two satellite speakers and one subwoofer) with at least 6 watts such as the widely-available brands known as Altec Lansing and Creative Labs.

Figure 5:
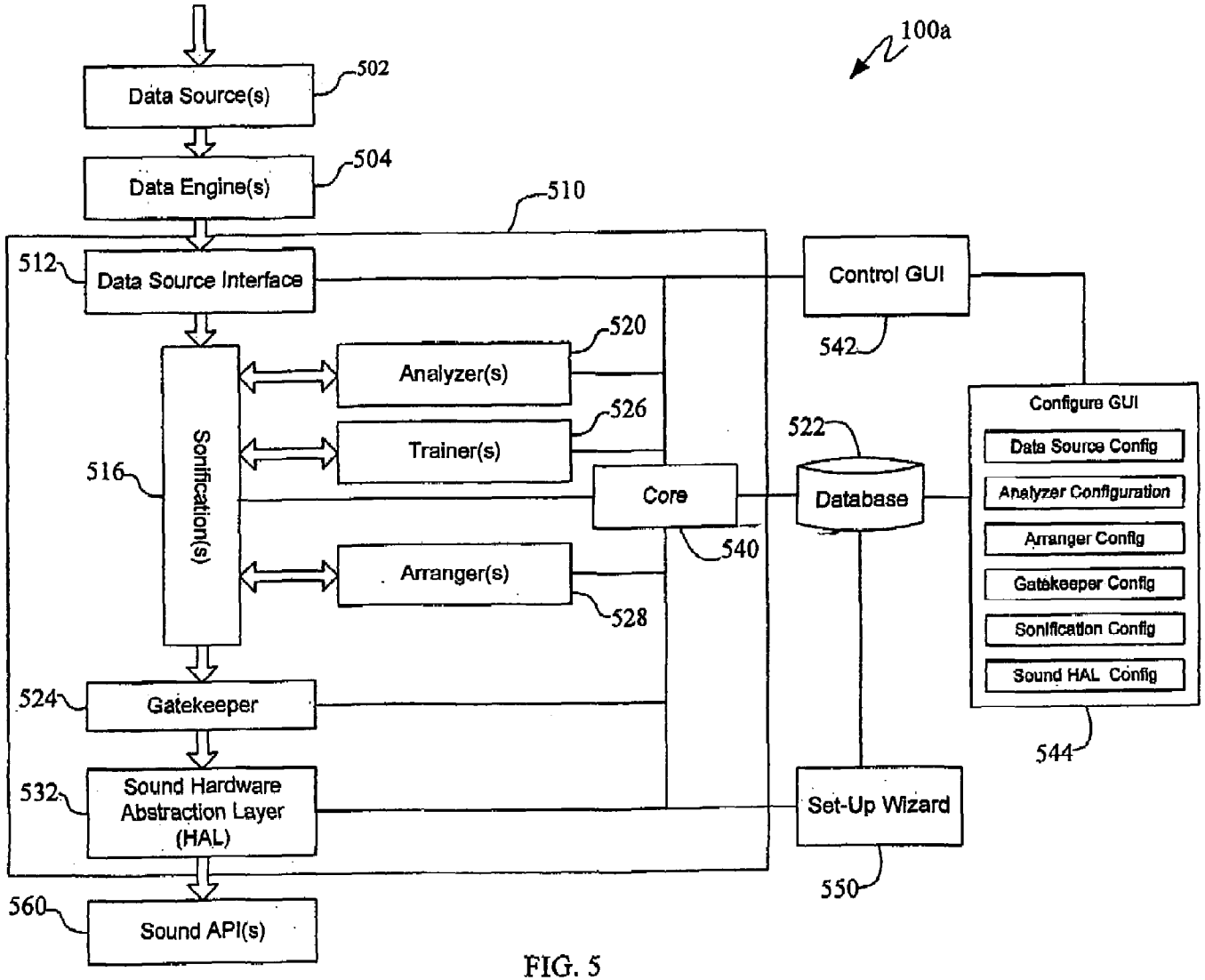
FIG. 5 is a block flow diagram illustrating one embodiment of a sonification system, consistent with the present invention.

The sonification engine may facilitate the real time sound creation and implementation of the custom auditory display. In the exemplary embodiment, the sonification engine may provide the underlying high quality sound engine for string ensemble (delta), harp (gamma) and bells (vega). The sonification engine may also provide any appropriate controls/effects such as onset, decay, duration, loudness, tempo, timbre (instrument), harmony, reverberation/echo, and stereo location. One embodiment of a sonification engine is described in greater detail in U.S. patent application Ser. No. 10/446,452, which is assigned to assignee of the present application and which is fully incorporated herein by reference. Another embodiment of a sonification engine is shown in FIG. 5 and is described in greater detail below. Those skilled in the art will recognize other embodiments of the sonification engine using known hardware and/or software.

Referring now to FIG. 5, one embodiment of the sonification system 100*a* is described in greater detail. The sonification system 100*a* may include a sonification engine 510, which may be independent of any industry-specific code and may function as a generic, flexible and powerful engine for transforming data into musical sound. The sonification engine 510 may also be independent of any specific arrangements for generating the sound. Thus, the format of the musical output may be independent of any specific sound application programming interface (API) or hardware device. Communication between the sonification engine 510 and such a device may be accomplished using a driver or hardware abstraction layer (HAL). The concept of a musical output that is hardware independent may also be implemented using software generally known to those skilled in the art, such as MIDI (Musical Instrument Digital Interface), JMSL (Java Musical Specification Language), and a general sonification interface called SONART implemented at CCRMA at Stanford University.

The exemplary embodiment of the sonification engine 510 may be configured to accept time-series data from any source including a real-time data source and historical data from some storage medium served up to the sonification engine as a function of time. Industry-specific data engines may be developed to transform raw time series data to a standard used by the sonification engine 510. The user may configure the sonification engine 510 with any industry specific information or terminology and establish configuration information (e.g., in the form of files or in some other permanent storage), which contain industry-specific data. The data to be sonified, however, may be formatted as to be industry-independent to the sonification engine 510. Thus, for example, the sonification engine 510 may not know whether a data stream is the temperature of oil in a processing plant or the change on the day of IBM stock. The sonification engine 510 may generate the appropriate musical output to reflect the upward and downward movement of either quantity. Thus, the exemplary sonification engine 510 is useful for various generic data behaviors.

The exemplary embodiment of the sonification engine 510 may also provide various types of sonifications schemes or modes including discrete sonification (i.e., the ability to track several data streams individually), moving to continuous sonification (i.e., the ability to track relationships between data streams), and polyphonic sonification (i.e., the ability to track a large number of data streams as a gestalt or global picture). Examples of sonification schemes and modes are described above and in co-pending U.S. patent application Ser. No. 10/446,452, which has been incorporated by reference. Furthermore, the sonification engine can be designed as a research and development and customized project tool and may allow for the "plug-in" of specialized modules.

One exemplary implementation and method of operation of the sonification system 100*a* including the sonification engine 510 is now described in greater detail. Data may be provided from one or more data sources or terminals 502 to one or more data engines 504. The data source(s) or terminal(s) 502 may include external sources (e.g., servers) of data commonly used in target industries. Examples of financial industry or market data terminals or sources include those available from Bloomberg, Thomson, Talarian, Tibco Rendezvous, TradeWeb, and Triarch. The data source or terminal(s) 502 may also include a flat file to provide historical data exploration or data mining.

The data engine(s) 504 may include applications external to the sonification engine 510, which have the ability to serve data from a data source or terminal 502 to the sonification engine 510. Data may be served either over a socket or over some other data bus platform (e.g., Tibco) or data exchange standard (e.g., XML). The data engine(s) 504 may be developed with the sonification engine 510 or may have some prior existence as part of an API (e.g. Tibco). An example of an existing data engine is the Bloomberg Data Server, which is a Visual Basic application. Another example of an existing data engine is a spreadsheet, such as a Microsoft Excel spreadsheet, that adapts real-time data delivered to the spreadsheet from data sources such as those available from Bloomberg, Thomson and Reuters to the sonification engine.

The sonification engine 510 may include one or more modules that perform the data processing and sound generation configuration functions. The sonification engine 510 may also include or interact with one or more modules that provide a user interface and perform configuration functions. The sonification engine 510 may also include or interact with one or more databases that provide configuration data.

In the exemplary embodiment, the sonification engine 510 may include a data source interface module 512 that provides an entry point to the sonification engine 510. The data source interface module 512 may be configured with source-independent information (e.g., stream, field, a pointer to a data storage object) and with source-specific information, which may be read from one or more data source configuration data, for example, in a database 522. For example, the source specific information for the Bloomberg data source may include an IP address and Port number; the source specific information for the Tibco data source may include service, network, and daemon; and the source specific information for a flat file may include the filename and path.

According to one method of operation, the data source interface module 512 initiates a connection based upon source-specific configuration information and requests data based upon source-independent configuration information. The data source interface module 512 may sleep until data is received from the data engine 504. The data source interface module 512 sends data to a sonification module 516 in a specified format, which may include filtering out data entities that are not necessary or are not complete and reformatting data to a standard format. According to one implementation, one instance of the data source interface module 512 may be created per data source with each instance being an independent thread.

The sonification module 516 may serve as a data buffer and processing manager for each data entity sent by the data source interface module 512. The exemplary embodiment of the sonification module 516 is not dependent on the sonification design. According to one method of operation, the sonification module 516 waits for data from the data source interface module 512, places the data in queue, and notifies a data analyzer module 520. According to one implementation, one instance of the sonification module 516 may be created per data entity, with each instance being an independent thread. Alternatively, the sonification module 516 may be implemented as a number of static methods, for example, with the arguments of the methods providing a pointer to ensure that the output goes to the correct sound HAL module 532.

The data analyzer module 520 decides if current data is actionable, for example, based on the sonification design and user-controlled parameters from entity configuration data, for example, located in the configuration database 522. The data analyzer module 520 may be configured based on the sonification design and may obtain information from the entity configuration data file(s) such as source, ID, sonification design, sound, and other sonification design specific user-controlled parameters. According to one method of operation, the data analyzer module 520 waits for notification from the sonification module 516. The data analyzer module 520 may perform additional manipulation of the data before deciding if the data is actionable. If the data is actionable, the data analyzer module 520 sends the appropriate arguments back to the sonification module 516. If the data is not actionable, the data analyzer module 520 may terminate. According to one implementation, one instance of the data analyzer module 520 may be created per data entity. According to another implementation, one instance of the data analyzer module 520 may be used for multiple sonifications. There may be one or more sonification designs applicable to a data entity; for example, a treasury note could have a bid-ask sonification and a change on the day sonification.

The sonification module 516 may convert actionable data to training information, such as visual cues or voice descriptions, by passing the actionable data to a trainer module 526. The trainer module 526 may perform further manipulations on the data to determine the type of training information to convey to the end-user. According on one implementation, the training module 526 may change the visual interface presented to the user by changing the color of a region or text to indicate both the data entity being sonified and whether the actionable data is an "up" event or a "down" event. According to another implementation, the training module 526 may generate speech or play speech samples that indicate which data entity is being sonified and the reason for the sonification.

The sonification module 516 may pass the actionable data from the data analyzer module 520 to an arranger module 528. The arranger module 528 converts the actionable data to musical commands or parameters, which are independent of the sound hardware/software implementation. Examples of such commands/parameters include start, stop, loudness, pitch(es), reverb level, and stereo placement. There may be a hierarchy of such commands/parameters. To play a major triad, for example, there may be a triad method which may, in turn, dispatch a number of start methods at different pitches. According to one method of operation, the arranger module 528 may convert actionable data to musical parameters according to the sonification design. The sonification module 516 may then send the musical parameters to a gatekeeper module 524 along with the sound configuration and data entity ID.

The gate keeper module 524 may be used to determine (e.g., based on user preferences) how events are processed if multiple actionable events are generated "at the same time," as defined within some tolerance. Possible actions may include: sonify only the high priority items and drop all others; sonify all items one after the other in some user-defined order; and sonify all items in canonical fashion or in groups of two and three simultaneously. The gate keeper module 524 may be configured to act differently, depending on the specific sonification design, and dependent on whether the sonification is discrete, continuous or polyphonic. According to one method of operation, upon notification from the sonification module 516 of an actionable event, the gate keeper module 524 may query a sound HAL module 532 for status. The gate keeper module 524 may then dispatch an event based on user options, sonification design and status of the sound HAL module 532. According to one implementation, the gate keeper module 524 may be a static method.

The sound HAL module 532 provides communication between the sonification engine 510 and one or more sound application programming interfaces (APIs) 560. A global mixer or master volume may be used, for example, if more than one sound API 560 is being used at the same time. The sound HAL module 532 may be configured with the location of the corresponding sound API(s) 560, hardware limitations, and control issues (e.g. the need to throttle certain methods or synthesis modes which could overwhelm the CPU). The sound HAL module 532 may read or obtain such information from the configuration database 522. According to one method of operation, the sound HAL module 532 sets up and initializes the corresponding sound API 560 and translates sonification output to an external format appropriate to the chosen sound API 560.

The sound HAL module 532 may also establish communication with the gate keeper module 524, in order to report status, and may manage overload conditions related to software/hardware limitations of a specific sound API 560. According to one implementation, there may be one instance of the sound HAL module 532 for each sound API 560 being used. Specific synthesis approaches may be defined within a given sound API 560; within JSyn, for example, a sample instrument, an FM instrument, or a triangle oscillator may be defined. This can be handled by subclassing.

The sound API(s) 560 reside outside of the sonification engine 510 and may be pre-existing applications or API's known to those skilled in the art for use with sound. The control of the level of output and providing a mixer from one or more of these API's 560 can be implemented using techniques known by those skilled in the art. The sound API(s) 560 may be configured with information from the sound HAL data in the configuration database 522. According to one method of operation, the sound API(s) 560 produce sounds based on standard parameters obtained from the sound HAL module 532. The sound API(s) 560 may inform the sound HAL module 532 as to when it is finished or how many sounds are currently playing.

A core module 540 provides the main entry point for the sonification engine 510 and sets up and manages components, user interfaces and threads. The core module 540 may obtain information from the configuration database 522. According to one method of operation, a user starts the sonification program and the core module 540 checks to ensure that a configuration exists and is valid. If no configuration exists, the core module 540 may launch a set-up wizard module 550 to provide the configuration or may use a default configuration. The core module 540 may then start and instantiate the sonification module(s) 516, which may start up the data analyzer module(s) 520, the trainer module(s) 526 and the arranger module(s) 528. The core module 540 may then start the data source interface module 512 and may start the sound HAL module 532, which initializes the sound API(s) 560. During operation, the core module 540 may prioritize and manage threads.

According to one implementation, the core module 540 may also start a control GUI module 542. The control GUI module 542 may then open a configure GUI module 544. The configure GUI module 544 allows the user to provide configuration information depending upon industry-specific information provided from the configuration database 522. Thus, the general format or layout of the configure GUI module 544 may not be specific to any industry or type of data. One embodiment of the configure GUI module 544 may provide a number of tabbed panels with options and content dependent upon the information obtained from the entity configuration data in the database 522. The tabbed panels may be used to separate sonification behaviors or schemes that have distinctly different user parameters. A different set of user parameters may be used, for example, for bid-ask sonification behaviors and movement sonification behaviors. Different sonification behaviors or schemes are described in greater detail above and in U.S. patent application Ser. No. 10/446,452, which has been incorporated by reference.

According to another implementation, the data engine 504 may be responsible for controlling and configuring the sonification engine 510. In this implementation, the data engine 504 may provide the control GUI 542 and the configure GUI 544 using techniques familiar to those skilled in the art to start, stop and configure the sonification engine. According to this implementation, a program menu provides menu items to start and stop the sonification engine 510 and to perform the function of the control GUI 542. This control GUI 542 may control the core module 540 through a socket or some other notification method. Another menu item in the program menu allows the user to configure the sonification engine 510 through a configure GUI 544 that reads, modifies and writes data in the configuration database 522. The configure GUI 544 may notify the core module 540 of changes to the configuration database 522 by restarting the sonification engine 510 or through a socket or other notification method.

According to one method of operation, the configure GUI module 544 may provide global sound configuration options such as enable/disable simultaneous sounds, maximum amount of simultaneous sounds, prioritizing simultaneous sounds, or queuing sounds v. playing sounds canonically. The configure GUI module 544 may be dynamically configurable, providing an instant preview of what a particular configuration will sound like. The configure GUI module 544 may also provide sound configurations common to all sonification schemes, such as tempo, volume, stereo position, and turning data entities on and off. The configure GUI module 544 may also provide sound configurations common to specific sonification schemes. For movement sonification schemes, for example, the configure GUI module 544 may be used to configure significant movement. For distance sonification schemes, the configure GUI module 544 may be used to configure significant distance and distance granularity. For interactive trading sonification schemes, the configure GUI module 544 may be used to configure significant size, subsequent trill size, and spread granularity. The configure GUI module 544 may also warn the user if a particular configuration is likely to have adverse affects (e.g., on CPU utilization, stacking, etc.) and may make suggestions, for example, to increase the significant movement or decrease the number of data items turned on.

The set-up wizard module 550 may include industry-specific jargon and setup information and may output this setup information to the configuration database 522. The set-up wizard module 550 may be used to provide an initial configuration or may be used to modify an existing configuration without having to restart the application. According to one method of operation of the set-up wizard module 550, the user may choose musical preferences such as a certain number of unique sounds provided for certain indices or securities, an assignment of a data entity to a specific sound, or an automated assignment of a data entity to a specific sound based on listening preferences (e.g., soft, medium hard), musical preferences (e.g., Jazz, Classical, Rock), and user defined descriptions. The set-up wizard module 550 may also be used to connect with a data source and to choose a data entity or item (e.g., a security/index or an attribute). The set-up wizard module 550 may further be used to configure user and I/T personnel email addresses.

The set-up wizard module 550 may also be used to choose a data behavior of interest (i.e., a sonification scheme) such as a movement-type behavior, a distance-type behavior and/or an interactive trading behavior. For a movement-type behavior, the user may configure a relative movement scheme or an absolute movement. A relative movement may be configured, for example, with a 2-note melodic fragment sonification scheme. An absolute movement may be configured, for example, with respect to a user defined value, using a 3 note melodic fragment, and to handle an out of octave condition graciously. For a distance-type behavior, the user may configure a fluctuation (e.g., price) and analytic sonification scheme such as a 4-note melodic fragment or an analytic and analytic sonification scheme such as a continuous sonification. For an interactive trading behavior, the user may configure a tremolando sonification scheme.

Embodiments of the system and method for musical sonification can be implemented as a computer program product for use with a computer system. Such implementation includes, without limitation, a series of computer instructions that embody all or part of the functionality previously described herein with respect to the system and method. The series of computer instructions may be stored in any machine-readable medium, such as semiconductor, magnetic, optical or other memory devices, and may be transmitted using any communications technology, such as optical, infrared, microwave, or other transmission technologies. It is expected that such a computer program product may be distributed as a removable machine-readable medium (e.g., a diskette, CD-ROM), preloaded with a computer system (e.g., on system ROM or fixed disk), or distributed from a server or electronic bulletin board over the network (e.g., the Internet or World Wide Web).

Those skilled in the art should appreciate that such computer instructions can be written in a number of programming languages for use with many computer architectures or operating systems. For example, preferred embodiments may be implemented in a procedural programming language (e.g., "C") or an object oriented programming language (e.g., "C++" or Java). Alternative embodiments of the invention may be implemented as pre-programmed hardware elements or as a combination of hardware and software.

Accordingly, sonification systems and methods consistent with the present invention provide musical sonification of data. Consistent with one embodiment of the present invention, a method of musical sonification of a data stream includes receiving the data stream including different data parameters and obtaining data values for at least two of the different data parameters in the data stream. The method of musical sonification determines pitch values corresponding to the data values obtained for the two different data parameters and the pitch values correspond to musical notes. The method of musical sonification plays the musical notes for the two different data parameters to produce a musical rendering of the data stream. Changes in the musical notes indicate changes of the data parameters in the data stream.

Consistent with another embodiment of the present invention, a method of musical sonification of a data stream may be used to monitor option trading. This embodiment of the method includes receiving a data stream including a series of data elements corresponding to options trades being monitored, each of the data elements including data parameters related to a respective trade. The data parameters may be mapped to pitch as the data stream is received, and at least two of the data parameters are mapped to pitch values within a different pitch range. The musical notes corresponding to the pitch values are played to produce a musical rendering of the data stream, and changes in the musical notes indicate changes in the data parameters.

Consistent with a further embodiment of the present invention, a system for musical sonification includes a sonification engine configured to receive a data stream including a series of data elements corresponding to financial trading events being monitored. The data elements include different data parameters related to a respective financial trading event. The sonification engine is also configured to obtain data values for the data parameters and to convert the data values into sound parameters such that changes in the data values resulting from the trades correspond to changes in the sound parameters. The system also includes a sound generator for generating an audio signal output from the sound parameters. The audio signal output includes a musical rendering of the data stream using the equal tempered scale.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A method of musical sonification of a data stream, said method comprising:

receiving said data stream including different data parameters;

obtaining data values for at least first and second data parameters of said different data parameters in said data stream;

determining at least first parameter pitch values and second parameter pitch values corresponding, respectively, to said data values obtained for said first and second data parameters, wherein said pitch values correspond to musical notes; and playing first parameter musical notes at said first parameter pitch values and second parameter musical notes at said second parameter pitch values to produce a musical rendering of said data stream, wherein changes in said musical notes indicate changes in said data values obtained for said data parameters in said data stream such that said musical rendering of said data stream distinguishes between said first and second data parameters in said data stream and between changes in said data values obtained for said first and second data parameters in said data stream.

2. The method of claim 1 wherein said pitch values correspond to notes in an equal tempered scale.

3. The method of claim 1 wherein said first and second parameter pitch values determined for said first and second data parameters are within first and second different pitch ranges, respectively.

4. The method of claim 3 wherein playing said first parameter and second parameter musical notes comprises playing musical notes using different instruments for said first and second data parameter musical notes.

5. The method of claim 3 wherein:

playing said first parameter musical notes comprises playing at least one sustained first parameter note at said first parameter pitch value in said first pitch range, wherein said at least one sustained first parameter note is sustained while playing at least some of said second parameter musical notes; and playing said second parameter musical notes comprises playing at least one reference note at an initial pitch value in said second pitch range followed by at least one of said second parameter notes at at least one of said second parameter pitch values in said second pitch range.

6. The method of claim 5 further compnsing:

obtaining data values for at least a third data parameter in said data stream; and determining at least one third parameter pitch value corresponding to at least one of said data values obtained for said third data parameter, wherein said third parameter pitch value corresponds to at least one third parameter musical note spaced from said second parameter note by an interval; and playing said at least one third parameter note following said second parameter note.

7. The method of claim 6 wherein a number of said third parameter notes to be played corresponds to a magnitude of said data value for said third data parameter.

8. The method of claim 7 wherein a plurality of third parameter notes are played together as a harmony.

9. The method of claim 8 wherein said harmony includes at least one of a major triad and a minor triad.

10. The method of claim 6 wherein a plurality of third parameter notes are played alternatively in sequence with said second parameter note, wherein a number of repeats of said notes played in sequence corresponds to a magnitude of said data value for said third data parameter.

11. The method of claim 1 wherein said data stream includes a series of data elements corresponding to events being monitored, each of said data elements including raw data for said data parameters related to a respective event.

12. The method of claim 11 wherein obtaining data values for at least one of said data parameters includes calculating a moving sum of said raw data over a period of time as said data elements are received.

13. The method of claim 11 wherein said data stream is a financial data stream, and wherein said data elements correspond to financial trading events.

14. The method of claim 13 wherein said financial data stream includes financial trading events for a portfolio, and wherein said musical rendering indicates portfolio changes of said data parameters.

15. The method of claim 11 wherein said data stream includes data elements corresponding to options trades, and wherein said data parameters include at least one of a delta, gamma and vega resulting from an option trade, and wherein each of said data elements further includes values representative of an expiration and strike related to said option trade.

16. The method of claim 1 wherein musical notes for at least two of said data parameters are played together as a harmony, said harmony including at least one of a major triad and a minor triad.

17. A method of musical sonification of a data stream for monitoring option trading, said method comprising:

receiving a data stream including a series of data elements corresponding to options trades being monitored, each of said data elements including data parameters related to a respective trade;

mapping said data parameters to pitch as said data stream is received, wherein at least two of said data parameters are mapped to pitch values within a different pitch range, wherein said pitch values correspond to musical notes; and playing said musical notes corresponding to said pitch values to produce a musical rendering of said data stream, wherein changes in said musical notes indicate changes in said data parameters, and wherein said musical rendering of said data stream distinguishes between said different data parameters to monitor changes in each of said different data parameters as a result of said options trades.

18. The method of claim 17 wherein said data parameters include at least a delta, gamma and vega, wherein mapping said data parameters comprises calculating moving sums of each of said delta, gamma and vega over a period of time, and wherein said pitch values are determined based on said moving sums.

19. The method of claim 18 wherein playing said musical notes comprises playing sustained musical notes for said delta.

20. The method of claim 18 wherein playing said musical notes comprises playing reference notes followed by musical notes for said gamma and said vega.

21. The method of claim 17 wherein each of said data elements includes a value representative of an expiration related to said trade, wherein said expiration is mapped to additional pitch values corresponding to musical notes, wherein playing said musical notes comprises playing said musical notes corresponding to said additional pitch values for said expiration in sequence with a musical note played for at least one of said data parameters, and wherein a number of said notes in said sequence indicates a magnitude of said value for said expiration.

22. The method of claim 17 wherein each of said data elements includes values representative of a strike related to said trade, wherein said strike is mapped to additional pitch values corresponding to musical notes, wherein playing said musical notes comprises playing said musical notes corresponding to said additional pitch values for said strike together with a musical note played for at least one of said data parameters to form a harmony, and wherein a number of said notes played together indicates a magnitude of said value for said strike.

23. The method of claim 22 wherein said harmony includes at least one of a major triad and a minor triad.

24. A machine-readable medium whose contents cause a computer system to perform a method for musical sonification of a data stream, said method comprising:

receiving said data stream including different data parameters;

obtaining data values for at least first and second data parameters of said different data parameters of said data stream;

determining at least first parameter pitch values and second parameter pitch values corresponding, respectively, to said data values obtained for said first and second data parameters, wherein said pitch values correspond to musical notes; and playing first parameter musical notes at said first parameter pitch values and second parameter musical notes at said second parameter pitch values produce a musical rendering of said data stream, wherein changes in said musical notes indicate changes in said data values obtained for said data parameters in said data stream such that said musical rendering of said data stream distinguishes between said first and second data parameters in said data stream and between changes in said data values obtained for said first and second data parameters in said data stream.

25. A machine-readable medium whose contents cause a computer system to perform a method for musical sonification of a data stream, said method comprising:

receiving a data stream including a series of data elements corresponding to options trades being monitored, each of said data elements including data parameters related to a respective trade;

mapping changes of each of said data parameters as said data stream is received, wherein each of said data parameters is mapped to pitch values within a different pitch range for each of said data parameters, wherein said pitch values correspond to musical notes; and playing said musical notes corresponding to said pitch values to produce a musical rendering of said data stream, wherein changes in said musical notes indicates changes in said data parameters, and wherein said musical rendering of said data stream distinguishes between said different data parameters to monitor changes in each of said different data parameters as a result of said options trades.

26. The machine-readable medium of claim 24 wherein said first and second parameter pitch values determined for said first and second data parameters are within first and second different pitch ranges, respectively.

27. The machine-readable medium of claim 24 wherein said data stream includes a series of data elements corresponding to events being monitored, each of said data elements including raw data for said data parameters related to a respective event.

28. The machine-readable medium of claim 25 wherein said data parameters include at least a delta, gamma and vega, wherein mapping said data parameters comprises calculating moving sums of each of said delta, gamma and vega over a period of time, and wherein said pitch values are determined based on said moving sums.

* * * * *